US006892723B2

(12) United States Patent
Anschütz et al.

(10) Patent No.: US 6,892,723 B2
(45) Date of Patent: May 17, 2005

(54) BAKING OVEN WITH A LIGHTING CONFIGURATION

(75) Inventors: Eduard Anschütz, Gaggenau (DE); Sylvia Peter, Kehl (DE); Frank Rödelsperger, Höchst (DE); Bernd Strolz, Baden-Baden (DE); Dieter Weiss, Bühl (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 23 days.

(21) Appl. No.: 10/331,533

(22) Filed: Dec. 30, 2002

(65) Prior Publication Data

US 2003/0116153 A1 Jun. 26, 2003

Related U.S. Application Data

(63) Continuation of application No. PCT/EP01/07178, filed on Jun. 25, 2001.

(30) Foreign Application Priority Data

Jun. 29, 2000 (DE) ..... 100 31 660

(51) Int. Cl.[7] ..... F24C 15/00

(52) U.S. Cl. ..... 126/273 R; 126/213; 126/19 R; 219/385; 219/391; 219/220; 392/416; 362/94

(58) Field of Search ..... 126/39 BA, 213, 126/273 R, 19 R; 219/220, 385, 386, 387, 391, 393, 405, 411, 214, 752; 392/411, 416, 418; 99/389; 362/92, 94

(56) References Cited

U.S. PATENT DOCUMENTS

| | | | | |
|---|---|---|---|---|
| 5,621,283 A | * | 4/1997 | Watson et al. | 315/362 |
| 5,676,459 A | | 10/1997 | Bedford et al. | |
| 6,373,030 B1 | * | 4/2002 | Waldrep | 219/411 |
| 2003/0131841 A1 | * | 7/2003 | Anschutz et al. | 126/213 |

FOREIGN PATENT DOCUMENTS

| | | |
|---|---|---|
| DE | 197 22 044 A1 | 12/1998 |
| DE | 199 06 990 A1 | 8/2000 |
| WO | WO 00/52392 | 9/2000 |

* cited by examiner

*Primary Examiner*—Jiping Lu
(74) *Attorney, Agent, or Firm*—John T. Winburn; Russell W. Warnock; Craig J. Loest

(57) ABSTRACT

A baking oven includes baking oven lighting reduced by a dimmer device of a control device not suddenly each time, but such that the lighting becomes continuously weaker over a time period visually evident to a user. The light intensity is, preferably, also continuously increased when the baking space lighting is switched on.

17 Claims, 1 Drawing Sheet

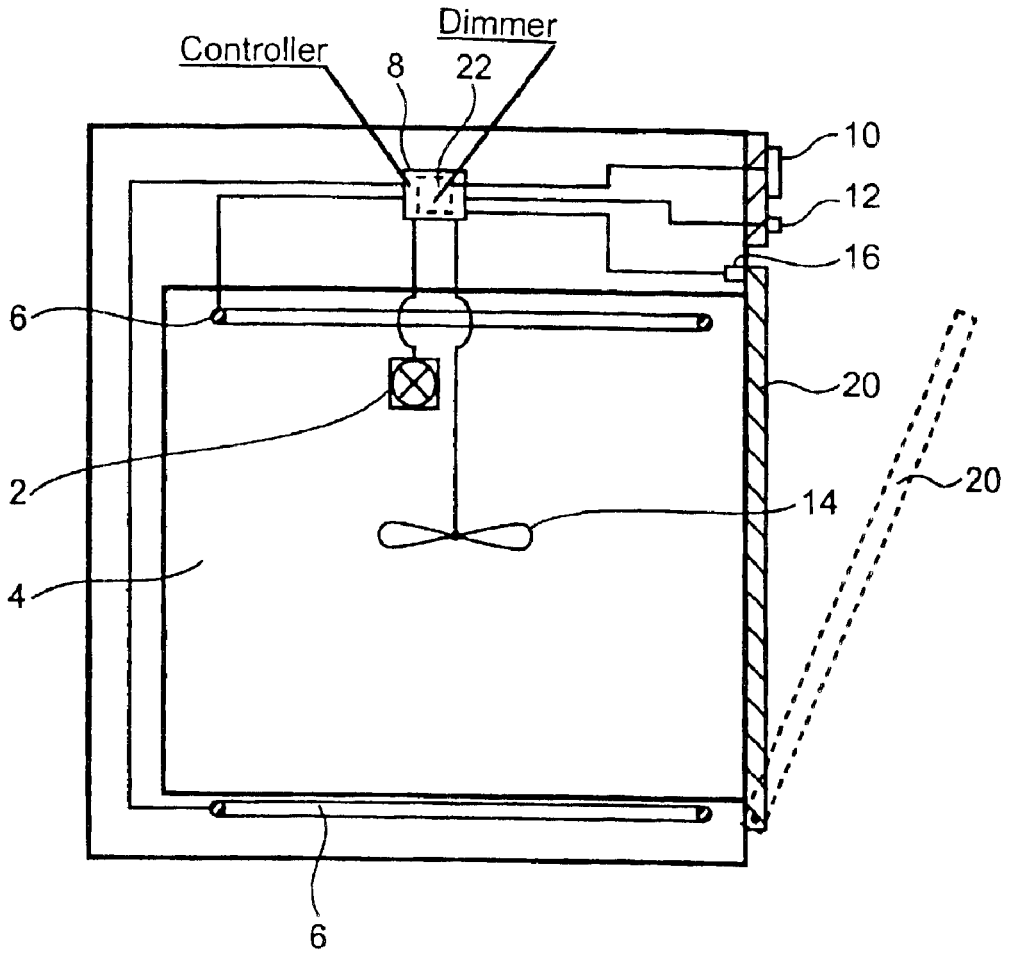
Controller
Dimmer
8
22
10
12
16
6
20
2
14
20
4
6

BAKING OVEN WITH A LIGHTING CONFIGURATION

CROSS-REFERENCE TO RELATED APPLICATION

This application is a continuation of copending International Application No. PCT/EP01/07178, filed Jun. 25, 2001, which designated the United States and was not published in English.

BACKGROUND OF THE INVENTION

Field of the Invention

The invention relates to a baking oven with baking space lighting that is switched on or switched off when a specific manually operable oven element is manually operated depending on the operating mode.

The baking space of a baking oven is heated by electrical heating elements or by gas flames and sensors measure the temperature. The heating elements and the temperature sensor form a control loop.

The baking space lighting contributes to the heating. Lighting devices may have a power output of up to 150 W and more. In the lower temperature range of the baking space at about 30 to 60° C., the baking space lighting contributes quite significantly to the heating of the baking space. In such a temperature range, it is only possible with difficulty to regulate the temperature in the baking space accurately and quickly by controlling the baking space heating. To be able to regulate very low temperatures, it is often better to switch off the baking space lighting completely. Even without baking space heating, the switched-on baking space lighting alone may, depending on the type of appliance, make the baking space heat up to over 60° C.

The baking space lighting also influences the heat distribution in the baking space. Lamps of the baking space lighting that are disposed at the sides in the baking space may lie very close to the food being cooked. The heat radiation of the baking space lighting may lead to intensified browning of the food.

The baking space serves for baking, roasting, grilling, stewing, or steaming food, and/or keeping it hot, etc.

To be able to regulate low temperatures, about 30° C. to 60° C., it is conventional to switch off the baking space lighting completely. It would also be possible to regulate such low temperatures exclusively with the baking space lighting as a heating element. A disadvantage of such a method would be that the user is at least initially irritated. It cannot be appreciated right away why, in some operating modes, the baking space lighting is switched off or even comes on and goes off at regular intervals.

Further disadvantages are that the user cannot adequately view the food when the baking space lighting is switched off. Furthermore, the baking space lighting is a quite important indication to the user that the baking oven is in operation and also generally contains food. If the baking space lighting is switched off, it may easily happen that the food is forgotten, which normally has the consequence of the food being burned or at least spoiled.

SUMMARY OF THE INVENTION

It is accordingly an object of the invention to provide a baking oven with a lighting configuration that overcomes the hereinafore-mentioned disadvantages of the heretofore-known devices of this general type and that configures the baking oven such that regulating the baking space temperature by controlling the baking space heating is possible even at low temperatures, for example, in the range from 30° C. to 60° C., without the regulation being disturbed by the temperature of the baking space lighting, and, at the same time, allows the user to be able to view the food for an extended time period by the light of the switched-on baking space lighting. Furthermore, disconcerting the user by "strange"lighting functions, such as, for example, flickering or the light going on and off, is to be avoided.

With the foregoing and other objects in view, in a baking oven having a baking space, operating modes, and at least one manually operable oven element, there is provided, in accordance with the invention, a lighting configuration including a baking space lighting connected to the oven element and respectively switched on and off, dependent upon at least one of the operating modes, when the oven element is manually operated and a control device connected to the baking space lighting, the control device having a dimmer device preventing a light intensity of the baking space lighting from being reduced to zero when the baking space lighting is switched off by automatically continuously reducing the baking space lighting over a predetermined extended time period visually evident to a user.

The light in the baking space is not just completely switched on and completely switched off, but either automatically set to a lower light intensity after a predetermined time period and/or the change in light intensity does not take place suddenly but continuously, preferably, steplessly by a dimmer device. In combination with a dimmer device, the switching off, and similarly the switching on, takes place by slow changing of the light intensity. Intermediate positions are conceivable, for example, only a quite weak light intensity. The changing of the light intensity takes place in each case over a predetermined time period and, preferably, steplessly.

Several possibilities for controlling the lighting are conceivable.

A first preferred version provides that, in every operating mode and at every temperature, the light is automatically switched down to a minimum value, preferably, dimmed down, after a specific time, for example, after 10 seconds, during which no operator control element or other oven element is operated. If any operator control element or other oven element is operated, for example, a knob, button, or the oven space door, the light is automatically made brighter, up to its maximum value, for a specific time, for example, for 10 seconds.

A second preferred version provides that, in every operating mode, but only in the critical low temperature range, for example, in the range between 30° C. and 60° C., and in the case of specific operating modes, for example, slow cooking or defrosting food, the baking space lighting is reduced to a minimum value. The light is increased, again, to its maximum value for a short time, for example, 10 seconds, by operating any operator control element or other oven element.

Several advantages arise from the invention.

First, temperature regulation is improved. The temperature in the baking space can be regulated in a simple way by controlling the customary heating elements, not only in the upper temperature range but also in the lower temperature range. The baking space is no longer heated up beyond the desired value.

Second, energy is saved. By automatically lowering the light intensity, energy is conserved and the user can still view the food well with the reduced lighting intensity. If a dimmer function is additionally installed, the user has time to view the food initially with brighter lighting and, then, with reduced lighting and is reassured by the changing light intensity that the oven is working in the way intended.

Third, operational reliability is improved. The fact that the baking space lighting is not switched off completely means that the user of the oven is always aware that the oven is switched on. As a result, the user does not forget to switch off the oven in time.

Fourth, operations are made more reliable. The fact that the light intensity of the baking space lighting is lowered from maximum intensity to a predetermined reduced intensity, preferably, lowered continuously by a dimmer function, in particular, steplessly, and, preferably, also raised by a dimmer, clearly indicates to the user that a deliberate operation is going on to produce these effects. Such an operation gives the user the assurance that the oven is working in the way intended. This soon becomes clear to the user even without operating instructions, which avoids the user interpreting switching-on and switching-off cycles as a malfunction.

Fifth, baking results are improved. Because the raising and lowering of the light intensity of the baking space lighting can take place at any temperature, in particular, also at low desired baking space temperature values, improved heat distribution in the baking space is possible. The influence of the baking space lighting on the heat distribution in the baking space is significantly reduced with reduced light intensity.

Finally, the lamps of the baking space lighting have a longer service life.

In accordance with another feature of the invention, the dimmer device prevents, when the baking space lighting is switched on, light from the baking space lighting from being suddenly produced with full light intensity by automatically causing the baking space lighting to become continuously stronger over a predetermined extended time period evident to a user.

In accordance with a further feature of the invention, the dimmer device prevents the light intensity of the baking space lighting from being immediately reduced to zero when the baking space lighting is switched off by automatically continuously reducing the baking space lighting over a predetermined extended time period visually evident to a user.

In accordance with an added feature of the invention, the at least one manually operable oven element is a plurality of manually operable oven elements, the control device is to be connected to the oven elements, the control device automatically reduces the baking space lighting from a full light intensity to a predetermined lower light intensity greater than zero if a first of the oven elements is not manually operated again within a predetermined time period after the first of the oven elements has been switched on and automatically resets the baking space lighting to the full light intensity if a second different one of the oven elements is manually operated, and, when the baking space lighting is brought into an off position, the dimmer device preventing light of the baking space lighting from being suddenly reduced even when switching over from the full light intensity to the predetermined lower light intensity by automatically reducing the baking space lighting to become continuously weaker over a predetermined extended time period visually evident to a user.

In accordance with an additional feature of the invention, when the baking space lighting is brought into an off position, the dimmer device automatically reduces the baking space lighting to become continuously and steplessly weaker.

In accordance with yet another feature of the invention, the dimmer device prevents light of the baking space lighting from being suddenly raised to the full light intensity when switching over from the predetermined lower light intensity to the full light intensity by automatically setting the light to become continuously stronger over a predetermined extended time period visually evident to a user. Preferably, the dimmer device automatically sets the light to become continuously and steplessly stronger.

In accordance with yet a further feature of the invention, the control device sets the predetermined lower light intensity only in a predetermined subset of the operating modes. Preferably, the control device sets the predetermined lower light intensity only in a case of one of the operating modes but not in a case of another different one of the predetermined oven operating modes.

In accordance with yet an added feature of the invention, the control device only sets the predetermined lower light intensity if a temperature in the baking space lies within a predetermined temperature range. Preferably, the control device only sets the predetermined lower light intensity if a temperature in the baking space lies within a predetermined lower temperature range, and not if the temperature lies within a predetermined higher temperature range.

In accordance with yet an additional feature of the invention, the at least one manually operable oven element is a plurality of manually operable oven elements including a baking oven door effecting one of a switching on and a switching off of the baking space lighting when the baking oven door is manually operated, an opening of the baking oven door automatically effecting a switching on of the baking space lighting and a closing of the baking oven door automatically effecting a switching off of the baking space lighting.

With the objects of the invention in view, there is also provided a baking oven, including a baking space, at least one manually operable oven element at the baking space, a baking space lighting at the baking space and connected to the oven element, a control device connected to the baking space lighting and having operating modes and a dimmer device preventing a light intensity of the baking space lighting from being substantially immediately reduced to zero when the baking space lighting is switched off by automatically continuously reducing the baking space lighting over a predetermined extended time period visually evident to a user, and the baking space lighting being respectively switched on and off, dependent upon at least one of the operating modes, when the oven element is manually operated.

In accordance with again another feature of the invention, the baking space defines an interior and the baking space lighting is disposed in the interior.

In accordance with again a further feature of the invention, the dimmer device prevents, when the baking space lighting is switched on, light from the baking space lighting from being suddenly produced with full light intensity by automatically causing the baking space lighting to become continuously stronger over a predetermined extended time period evident to a user.

With the objects of the invention in view, there is also provided a lighting configuration, including a lighting assembly to be connected to at least one manual operating element, a control device to be connected to the lighting assembly, the control device having operating modes and a dimmer device preventing a light intensity of the lighting assembly from being substantially immediately reduced to zero when the lighting assembly is switched off by automatically continuously reducing the lighting assembly over a predetermined extended time period visually evident to a user, and the lighting assembly being respectively switched on and off, dependent upon at least one of the operating modes, when the oven element is manually operated.

Other features that are considered as characteristic for the invention are set forth in the appended claims.

Although the invention is illustrated and described herein as embodied in a baking oven, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWING

The FIGURE is a schematic cross-sectional view through a baking oven according to the invention.

DESCRIPTION OF THE PREFERRED EMBODIMENT

Referring now to the single FIGURE of the drawing, it is seen that a baking oven according to the invention has a lamp 2 as lighting in a baking space 4. In a way similar to electrical heating elements 6 of the baking space heating, the lamp 2 is switched on and off by an electrical or electronic control device 8 in accordance with the manual operation of manually operable elements of the oven, for example, a manual operator control element 10 for switching the heating elements 6 on and off and for setting the temperature in the baking space, and also a manual operator control element 12 for setting the operating mode of the baking space, for example, for heat from below or heat from above or for circulating air by a fan 14, and an electrical switch 16, which is operated by the baking space door 20 when it is closed and opened. The baking space door 20 is, consequently, a "manually operable oven element."The door 20 is shown in the closed position by solid lines and in a partially open position by dashed lines.

The control device 8 is configured to automatically reduce the baking space lighting 2 from a full light intensity to a predetermined lower light intensity, which is greater than zero, if the or another specific oven element 10, 12, 16/20 is not manually operated again within a predetermined time period after the element 10, 12, 16/20 has been switched on, but the full light intensity is automatically reset if the or another specific one of the oven elements 10, 12, 16/20 apart from the oven element concerned, in the case of the example shown here the operator control element 10 for switching the baking space heating 6 on and off, is manually operated again; with such a renewed manual operation, the operator control element 10 is brought into an off position provided thereon for switching off the baking space heating 6.

At least the embodiments set forth in the following text are conceivable. The baking space lighting 2 is always automatically switched on whenever one of the oven elements 10, 12 or 16/20 is operated, regardless of whether or not the baking space heating 6 is switched on at the oven element or operator control element 10. According to another embodiment, it is possible that the baking space lighting 2 cannot be switched on or switched off by the operating-mode operator control element 12 and the baking space door 20 or its switch 16 unless the baking space heating 6 is switched on at the operator control element 10 provided for such a purpose. These enumerations do not exclude further embodiments.

According to a preferred embodiment of the invention, the control device 8 includes a dimmer device 22, by which the light of the baking space lighting 2 does not suddenly go out or is suddenly reduced to the predetermined low light intensity whenever it is switched off, but is set such that each time it automatically becomes continuously weaker, preferably, steplessly, over a predetermined extended time period, which is evident to a user.

Furthermore, the dimmer device 22 may be configured such that the light of the baking space lighting 2 does not suddenly reach the full light intensity whenever it is switched on at one of the oven elements 10, 12, 16/20, but is set by the dimmer device such that each time it automatically becomes continuously stronger, preferably, steplessly, over a predetermined extended time period, which is visually evident to a user.

Moreover, the control device 8 may be configured such that it only sets the predetermined low light intensity when the temperature in the baking space 4 lies within a predetermined low temperature range, for example, between 30° C. and 60° C., but not when it lies within a predetermined higher temperature range lying thereabove.

We claim:

1. In a baking oven having a baking space, operating modes, and a plurality of manually operable oven elements, a lighting configuration comprising:

a baking space lighting connected to the oven element and respectively switched on and off, dependent upon at least one of the operating modes, when the oven element is manually operated; and a control device connected to said baking space lighting, said control device having a dimmer device preventing a light intensity of said baking space lighting from being reduced to zero when said baking space lighting is switched off by automatically continuously reducing said baking space lighting over a predetermined extended time period visually evident to a user;

said control device to be connected to the oven elements, said control device automatically reducing said baking space lighting from a full light intensity to a predetermined lower light intensity greater than zero if a first of the oven elements is not manually operated again within a predetermined time period after the first of the oven elements has been switched on and automatically reseting said baking space lighting to the full light intensity if a second different one of said oven elements is manually operated; and when said baking space lighting is brought into an off position, said dimmer device preventing light of said baking space lighting from being suddenly reduced even when switching over from the full light intensity to the predetermined lower light intensity by automatically reducing said baking space lighting to become continuously weaker over a predetermined extended time period visually evident to a user.

2. The lighting configuration according to claim 1, wherein said dimmer device prevents, when said baking space lighting is switched on, light from said baking space lighting from being suddenly produced with full light intensity by automatically causing said baking space lighting to become continuously stronger over a predetermined extended time period evident to a user.

3. The lighting configuration according to claim 1, wherein said dimmer device prevents said light intensity of said baking space lighting from being immediately reduced to zero when said baking space lighting is switched off by automatically continuously reducing said baking space lighting over a predetermined extended time period visually evident to a user.

4. The lighting configuration according to claim 1, wherein, when said baking space lighting is brought into an off position, said dimmer device automatically reduces said baking space lighting to become continuously and steplessly weaker.

5. The lighting configuration according to claim 1, wherein said dimmer device prevents light of said baking space lighting from being suddenly raised to the full light intensity when switching over from the predetermined lower light intensity to the full light intensity by automatically setting the light to become continuously stronger over a predetermined extended time period visually evident to a user.

6. The lighting configuration according to claim 5, wherein said control device sets the predetermined lower light intensity only in a case of one of the operating modes but not in a case of another different one of the predetermined oven operating modes.

7. The lighting configuration according to claim 5, wherein said control device sets the predetermined lower light intensity only in a predetermined subset of the operating modes.

8. The lighting configuration according to claim 1, wherein said dimmer device prevents light of said baking space lighting from being suddenly raised to the full light intensity when switching over from the predetermined lower light intensity to the full light intensity by automatically setting the light to become continuously and steplessly stronger over a predetermined extended time period visually evident to a user.

9. The lighting configuration according to claim 1, wherein said control device sets the predetermined lower light intensity only in a case of one of the operating modes but not in a case of another different one of the predetermined oven operating modes.

10. The lighting configuration according to claim 1, wherein said control device sets the predetermined lower light intensity only in a predetermined subset of the operating modes.

11. The lighting configuration according to claim 1, wherein said control device only sets the predetermined lower light intensity if a temperature in the baking space lies within a predetermined lower temperature range, and not if the temperature lies within a predetermined higher temperature range.

12. The lighting configuration according to claim 1, wherein said control device only sets the predetermined lower light intensity if a temperature in the baking space lies within a predetermined temperature range.

13. The lighting configuration according to claim 1, wherein said plurality of manually operable oven elements includes a baking oven door effecting one of a switching on and a switching off of said baking space lighting when said baking oven door is manually operated, an opening of said baking oven door automatically effecting a switching on of said baking space lighting and a closing of said baking oven door automatically effecting a switching off of said baking space lighting.

14. A baking oven, comprising;

a baking space:

a plurality of manually operable oven elements at said baking space;

a baking space lighting disposed at said baking space and connected to said oven elements;

a control device connected to said baking space lighting and having:

operating modes; and a dimmer device preventing a light intensity of said baking space lighting from being reduced to zero when said baking space lighting is switched off by automatically continuously reducing said baking space lighting over a predetermined extended time period visually evident to a user; and said baking space lighting being respectively switched on and off, dependent upon at least one of said operating modes, when said oven elements are manually operated;

said control device to be connected to said oven elements, said control device automatically reducing said baking space lighting from a full light intensity to a predetermined lower light intensity greater than zero if a first of said oven elements is not manually operated again within a predetermined time period after the first of said oven elements has been switched on and automatically reseting said baking space lighting to the full light intensity if a second different one of said oven elements is manually operated; and when said baking space lighting is brought into an off position, said dimmer device preventing light of said baking space lighting from being suddenly reduced even when switching over from the full light intensity to the predetermined lower light intensity by automatically reducing said baking space lighting to become continuously weaker over a predetermined extended time period visually evident to a user.

15. The baking oven according to claim 14, wherein:

said baking space defines an interior; and said baking space lighting is disposed in said interior.

16. The baking oven according to claim 14, wherein said dimmer device prevents, when said baking space lighting is switched on, light from said baking space lighting from being suddenly produced with full light intensity by automatically causing said baking space lighting to become continuously stronger over a predetermined extended time period evident to a user.

17. A lighting configuration, comprising:

a lighting assembly to be connected to a plurality of manual operating elements;

a control device to be connected to said lighting assembly, said control device having:

operating modes; and a dimmer device preventing a light intensity of said lighting assembly from being reduced to zero when said lighting assembly is switched off by automatically continuously reducing said light intensity of said lighting assembly over a predetermined extended time period visually evident to a user; and said lighting assembly being respectively switched on and off, dependent upon at least one of said operating modes, when said elements are manually operated;

said control device to be connected to said elements, said control device automatically reducing said light intensity of said lighting assembly from a full light intensity to a predetermined lower light intensity greater than zero if a first of said elements is not manually operated again within a predetermined time period after the first of said elements has been switched on and automatically reseting said light intensity of said lighting assembly to the full light intensity if a second different one of said elements is manually operated; and when said lighting assembly is brought into an off position, said dimmer device preventing light of said lighting assembly from being suddenly reduced even when switching over from the full light intensity to the predetermined lower light intensity by automatically reducing said intensity of said lighting assembly to become continuously weaker over a predetermined extended time period visually evident to a user.

* * * * *